US009149120B2

(12) United States Patent
Crofts

(10) Patent No.: US 9,149,120 B2
(45) Date of Patent: Oct. 6, 2015

(54) RECLINING MECHANISM FOR AN ITEM OF FURNITURE

(76) Inventor: Gerard Crofts, Dublin (IE)

( * ) Notice: Subject to any disclaimer, the term of this patent is extended or adjusted under 35 U.S.C. 154(b) by 296 days.

(21) Appl. No.: 13/815,295

(22) PCT Filed: Aug. 19, 2011

(86) PCT No.: PCT/EP2011/004189

§ 371 (c)(1),
(2), (4) Date: Sep. 9, 2013

(87) PCT Pub. No.: WO2012/022490

PCT Pub. Date: Feb. 23, 2012

(65) Prior Publication Data

US 2014/0001805 A1 Jan. 2, 2014

(30) Foreign Application Priority Data

Aug. 20, 2010 (GB) ..... 1013965.7

(51) Int. Cl.

| | |
|---|---|
| ***A47C 17/12*** | (2006.01) |
| ***A47C 1/026*** | (2006.01) |
| ***A47C 1/025*** | (2006.01) |

(52) U.S. Cl.

CPC ..... *A47C 1/025* (2013.01); *A47C 1/026* (2013.01); *A47C 17/12* (2013.01)

(58) Field of Classification Search

CPC ..... B60N 2/2352; A47C 17/12; A47C 1/025; A47C 1/026

USPC ..... 297/354.1, 354.12, 356, 367 R

See application file for complete search history.

(56) References Cited

U.S. PATENT DOCUMENTS

| | | | | | |
|---|---|---|---|---|---|
| 1,193,802 | A | * | 8/1916 | Lenard | 297/368 |
| 3,484,831 | A | * | 12/1969 | Higuchi | 403/103 |
| 3,779,655 | A | * | 12/1973 | Toyota | 403/93 |
| 4,354,710 | A | * | 10/1982 | Rauschenberger | 297/356 |
| 4,657,303 | A | * | 4/1987 | Croft | 297/362 |
| 4,659,146 | A | * | 4/1987 | Janiaud | 297/367 R |
| 4,872,726 | A | * | 10/1989 | White et al. | 297/367 R |
| 5,169,257 | A | * | 12/1992 | Liou | 403/95 |

(Continued)

FOREIGN PATENT DOCUMENTS

| | | |
|---|---|---|
| DE | 3030713 A | 3/1982 |
| EP | 0 589 542 B1 | 3/1994 |

(Continued)

*Primary Examiner* — David R Dunn
*Assistant Examiner* — Timothy J Brindley
(74) *Attorney, Agent, or Firm* — One3 IP Management, P.C.; Jeromye V. Sartain

(57) ABSTRACT

A reclining mechanism (1, 1*a*) for an item of furniture comprising a pair of linkage units (2, 2*a*), each having a first arm (21, 21*a*) and a second arm (22, 22*a*) adapted to be secured to, respectively a stationary (40) and a reclining (41) part an item of furniture (4) adapted for moving the reclining part between upright and reclined positions. The first and the second arms are pivotally connected to each other at their first ends (23, 23*a*; 24, 24*a*) and ratchet arrangement (26, 27, 28) is provided between the first and the second arms which allows the second arm to rotate in one direction while preventing its rotation in the opposite direction. The linkage units are spaced apart from each other and are connected by a pivot bar (30) connected at its ends to the ratchet arrangement of each linkage unit and actuatable by a lever (31) for overriding the rotation preventing action of the ratchet mechanism to allow the second arm to rotate freely.

38 Claims, 10 Drawing Sheets

(56) References Cited

U.S. PATENT DOCUMENTS

| | | | | |
|---|---|---|---|---|
| 5,397,168 | A * | 3/1995 | Hand | 297/356 |
| 5,518,295 | A * | 5/1996 | Westerburgen | 297/367 R |
| 6,540,297 | B2 * | 4/2003 | Hansel et al. | 297/367 R |
| 6,789,848 | B2 * | 9/2004 | Rauschenberger et al. | 297/369 |
| 6,796,612 | B2 * | 9/2004 | Shephard | 297/367 R |
| 7,984,531 | B2 * | 7/2011 | Moore | 16/326 |
| 2009/0309403 | A1 * | 12/2009 | Mackert | 297/354.13 |
| 2010/0237667 | A1 * | 9/2010 | Guy et al. | 297/183.1 |
| 2014/0001805 | A1 * | 1/2014 | Crofts | 297/354.1 |

FOREIGN PATENT DOCUMENTS

| | | | |
|---|---|---|---|
| GB | 2017 806 | B | 7/1982 |
| GB | 191205508 | A | 5/2012 |
| JP | 2001178574 | A | 7/2001 |
| WO | WO 91/00667 | | 2/1992 |

* cited by examiner

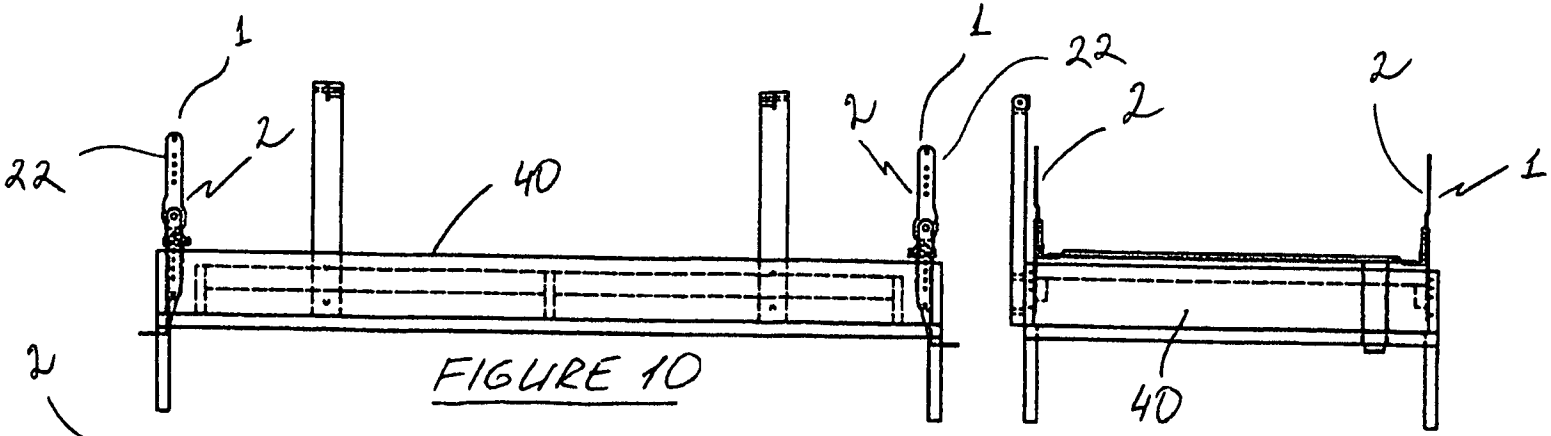
FIGURE 9
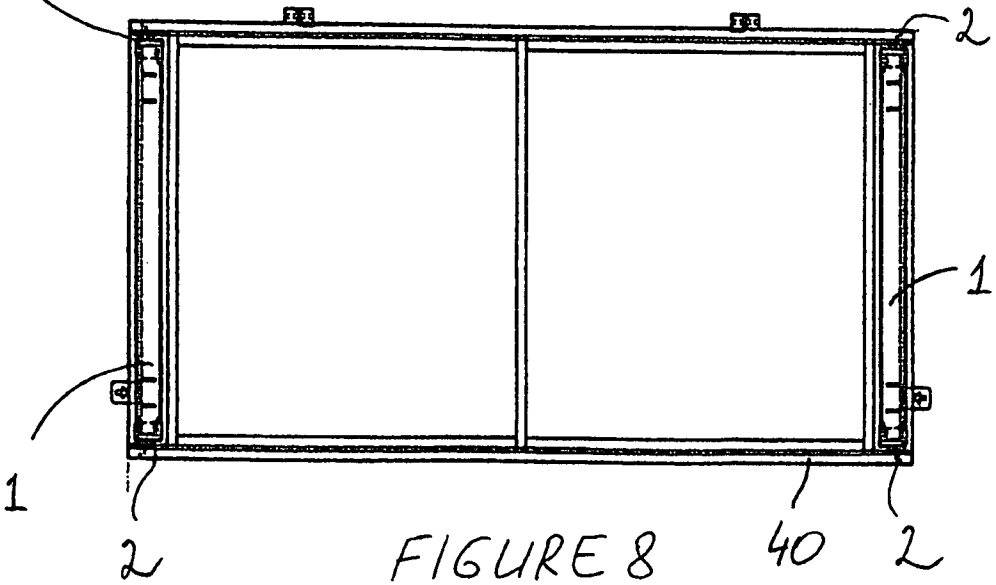
FIGURE 8
FIGURE 10

RECLINING MECHANISM FOR AN ITEM OF FURNITURE

PRIORITY

This application claims priority on PCT/EU2011/004189 filed Aug. 19, 2011, which claims priority on GB Application No. 1013965.7 filed Aug. 20, 2010.

FIELD OF THE INVENTION

The present invention relates to a reclining mechanism and in particular to a reclining mechanism for an item of furniture, more particularly for an item of furniture for seating, such as, for example, but not limited thereto, a sofa, a sofa-bed, an arm-chair, a couch or the like.

BACKGROUND OF THE INVENTION

It is known to provide upholstered furniture with recliner linkage for moving armrests or a backrest with respect to a seat between upright and reclined positions. Typical disadvantages of existing mechanisms include cumbersome construction and/or the presence of a gap or gaps between the seat and the reclined armrest or backrest.

It is an object of the present invention to overcome the above disadvantages and to provide a reclining mechanism which is relatively simple in construction, easy to manufacture and convenient in use.

SUMMARY OF THE INVENTION

Accordingly, the present invention provides a reclining mechanism for an item of furniture, the reclining mechanism comprising

- a pair of linkage units, each linkage unit comprising a first arm adapted to be secured to a stationary part of an item of furniture and a second arm adapted to be secured to a reclining part of the item of furniture for moving the reclining part between upright and reclined positions;
- wherein the first and the second arms are connected to each other at their first ends to pivot with respect to each other about a first pivot axis; the linkage units being spaced apart from each other so that their first pivot axes are collinear;
- wherein a ratchet arrangement provided between the first and the second arms adjacent the first pivot axis,
- wherein the linkage units are connected by a pivot bar pivotable about a second pivot axis substantially parallel to the first pivot axes; wherein the pivot bar is connected at its ends to the ratchet arrangement of each linkage unit; and wherein the pivot bar is pivotable about the second pivot axis by a lever;
- wherein in a first mode of operation of the reclining mechanism, the ratchet arrangement is bias loaded and is engaged with the first and the second arms of the linkage unit so that the second arm is prevented from rotation about the first pivot axis in a first direction from an upright to a reclined position while remaining rotatable in a second opposite direction from a reclined position to an upright position; and
- wherein in a second mode of operation the lever is actuated, whereby the pivot bar is pivoted about the second pivot axis thereby releasing the ratchet arrangement from the bias load thereby releasing the second arm so that the second arm is free to rotate about the first pivot axis between upright and reclined positions.

In use, the first arm is fixed to a stationary portion of an item of furniture, such as a sofa base, seat or frame, whereas the second arm is fixed to a reclining portion of the item of furniture, such as an armrest or a backrest.

Preferably, each linkage unit includes a first stop member arranged to prevent further rotation of the second arm in the second direction once it has moved from the reclined into the upright position. Thus, in the first mode of operation (i.e. when the engaging members of the ratchet are engaged), once the second arm has reached the upright position, it is prevented from rotation in both directions, i.e. the second arm assumes a fixed upright position with respect to the first arm.

Preferably, each linkage unit includes a second stop member arranged to prevent rotation of the second arm in the first direction once the second arm has rotated from the upright to the reclined position. Thus, in the second mode of operation (i.e. when the engaging members of the ratchet are disengaged and the second arm is freely rotatable), once the second arm has reached the reclined position, it is prevented from further rotation in the first direction by the second stop member, but can be rotated freely in the second direction towards the upright position. Preferably, in the reclined position, the first and the second arms are positioned at a substantially right angle with respect to one another and, in use, the first arm is substantially upright and the second arm is substantially horizontal.

Due to such an arrangement of the reclining mechanism of the invention, by a single actuation of the lever, the second arms of the linkage units are brought into the second mode of operation so that the second arms are free to rotate relative to the respective first arms and, accordingly, so that the reclining part of the item of furniture can be readily reclined or raised.

Ideally, the ratchet arrangement comprises a first engaging member movably mounted on the first arm, the first engaging member being releasably engaged with a second engaging member provided at the second arm; and the bias load is provided by a biasing means biasing the first engaging member into the engagement with the second engaging member. Preferably, the pivot bar is connected at its ends to the first engaging members.

Accordingly, in a first mode of operation of the reclining mechanism, the first engaging member is biased into an engagement with the second engaging member by the biasing means so that the second arm is prevented from rotation about the first pivot axis in a first direction from an upright to a reclined position while remaining rotatable in a second opposite direction from a reclined position to an upright position; and wherein in a second mode of operation, the lever is actuated, whereby the pivot bar is pivoted about the second pivot axis, whereby the first engaging members are moved away from the respective second engaging members overcoming the bias force of the biasing means; and whereby the first engaging members become disengaged from the second engaging member so that the second arm is free to rotate about the first pivot axis between upright and reclined positions.

Advantageously, the centre of gravity of the second arm in the linkage unit is located so that in use once the linkage units are brought into in the second mode of operation in which the second arms are free to rotate, the second arms rotate under the influence of gravity from the upright position into the reclined position.

Preferably, the lever extends radially from the pivot bar. The lever is preferably actuatable via an application of an external force thereto. The external force is preferably tangential to the second pivot axis.

Ideally, in the first mode of operation of the reclining mechanism, the lever remains in a rest position whereas in the second mode of operation, the lever is actuated and moved from the rest position to a biased position upon application of the external force.

Once the external actuating force acting on lever the has been removed, the biasing means returns into its initial position thereby moving the first engaging members back into the engagement with their respective second engaging members, thereby pivoting the pivot bar about the second pivot axis in the reverse direction, thereby bringing the lever back into the rest position and bringing the reclining mechanism into the first mode of operation. Accordingly, once the second arm has moved into the reclined position, it is prevented from further rotation in the first direction by the ratchet arrangement; but can be raised to the upright position without using the lever. Ideally, ratchet arrangement is adapted to provide a series of discrete positions for the second arm as it rotates in the second direction in the first mode of operation of the reclining mechanism.

In one arrangement, the first engaging member is pivotally mounted on the first arm to pivot about the second pivot axis together with the pivot bar.

In one embodiment, the first engaging member comprises a pawl and the second engaging member comprises a gear. The gear preferably comprises asymmetrical teeth, wherein each tooth preferably has first and second slopes configured so that when the second arm is rotated in the second direction from the reclined to the upright position in the first mode of operation of the reclining mechanism, the first slope of a tooth slides up and over the pawl at the same time overcoming the bias force of the biasing means and pushing the pawl out of a valley between a pair of adjacent teeth. Once the tip of the tooth has passed over the pawl, the bias means pushes the pawl into the valley between the next pair of adjacent teeth. When an attempt is made to rotate the second arm in the first direction from the upright to the reclined position in the first mode of operation of the reclining mechanism, the second slope of a tooth catches against the pawl and locks therewith thereby preventing any further rotation in the first direction.

Preferably, the biasing means comprises a biasing member mounted between the first arm and the first engaging member. In one arrangement, the biasing member is provided in the form of a spring, preferably a leaf spring. In one variation, the leaf spring is secured to the first arm at one end and is slidably engaged with the first engaging member at the other end.

In a preferred arrangement, the reclining mechanism is built into an item of furniture, such as, for example, a sofa so that the first arms are secured within a stationary part of the item of furniture and the second arms are secured within a reclining part of the item of furniture, whereas the linkage units are spaced along adjoining sides of the stationary part and the reclining part.

Preferably, the lever comprises a free end provided with a pedal. Ideally, the reclining mechanism is built into an item of furniture so that the lever extends downwardly from the pivot bar inside the stationary part and remains concealed within the stationary part together with the pivot bar, whereas the pedal sufficiently projects laterally from underneath the stationary part in the rest position of the lever, so that it can be accessed by a user and actuated e.g. by foot or by hand. Preferably, in the biased position of the lever, the pedal is pushed inwardly with respect to the exterior of the stationary part, whereby the lever is tilted inwardly through a pre-determined angle. Ideally, the biasing means of the ratchet arrangement is configured in such a manner and the length of the lever and the pre-determined angle are selected such that in the second position the pedal is at least partially concealed underneath the stationary part. Ideally, in the second position, the pedal partially projects from underneath the stationary part, so that the user does not need to reach underneath the stationary part in order to complete the actuation of the lever.

In one arrangement, the stationary part comprises a generally L-shaped in cross section recess defined by an upright wall and a generally horizontal ledge of the stationary part for receiving a generally U-shaped in cross-section reclining part comprising an elongate base comprising a pair of long edges and an pair of short edges and a pair opposing side walls upstanding from the long edges of the base and a pair of opposing end walls upstanding from the short edges of the base.

Preferably, in an upright position of the reclining part, the elongate base extends substantially parallel the ledge of the stationary part, whilst the side walls extend substantially vertically, substantially parallel the upright wall of the stationary part.

Conversely, in a reclined position of the reclining part, the elongate base extends substantially parallel the upright wall, whilst the side walls extend substantially parallel the ledge of the stationary part.

Preferably, the reclining mechanism is configured so that when it is secured within the item of furniture, the first pivot axis is substantially parallel the ledge and the upright wall of the stationary part; wherein the first pivot axis is spaced inwardly with respect to the exterior of the reclining part from the elongate base and from the side walls. Preferably, in the upright position, one of the side walls of the reclining part abuts the upright wall of the stationary part. Advantageously, the elongate base of the reclining part is sufficiently upwardly spaced from the ledge to provide clearance for the rotary movement of the reclining part about the first pivot axis between the upright and the reclined positions. Ideally, the elongate base of the reclining part is upwardly spaced from the ledge and the first pivot axis is inwardly (i.e. with respect to the exterior of the reclining part) spaced from the elongate base of the reclining part and from a side wall of the reclining part remote the upright wall of the stationary part so that a portion of the elongate base most remote from the first pivot axis slides against a portion of the ledge during the movement of the reclining part between the reclined and the raised positions.

Ideally, the reclining part comprises a first elongate shield member extending along a long edge of the elongate base of the reclining part adjacent the upright wall of the stationary part and projecting proud therefrom, so that in the reclined position of the reclining part the first shield member covers a gap defined between the upright wall of the stationary part and the elongate base, whereas in the upright position of the reclining part the first shield member is concealed within the interior of the stationary part. Ideally, the elongate base of the reclining part is upwardly spaced from the ledge and the first pivot axis is inwardly spaced from the elongate base of the reclining part and laterally outwardly with respect to the exterior of the stationary part from the upright wall of the stationary part and a recess is provided in the upright wall for accommodating the elongate shield member during the rotary movement of the reclining part about the first pivot axis between the upright and the reclined positions. Ideally, the recess is covered by a flexible cover, ideally made from upholstery fabric which sags under the pressure of the shield member during the rotary movement of the reclining part about the first pivot axis between the upright and the reclined positions thereby allowing the shield member to enter the recess. In a preferred variation, ends of the elongate first shield member are located spaced from the corresponding short sides of the elongate base and, accordingly, the elongate shield member is received in the recess in the upright wall of the stationary part within the boundaries of the upright wall, i.e. it is shorter than the width of the upright wall, and the recess is not visible during the use of the item of furniture.

Preferably, a hollow area is defined inside the reclining part at least adjacent the elongate base for accommodating parts of the reclining mechanism. Ideally, a portion of the elongate base of the reclining part and a portion of the side wall thereof remote the upright wall of the stationary part are removed thereby providing openings to enable the reclining part to move with respect to the first arms of the linkage units which remain stationary during the rotation of the second arms without interfering with the first arms.

Ideally, the pivot bar and a portion of the first arm containing the first end of the first arm are disposed within the hollow area of the reclining part.

Preferably, a second elongate shield member extends along an outer long edge of the generally horizontal ledge of the stationary part and projects upwardly therefrom such that in the reclined position of the reclining part, the second shield member covers a gap defined between the generally horizontal ledge and the side wall of the reclining part remote the upright wall of the stationary part.

In a preferred variation, the shield member is provided in the form of a flexible strip, ideally a strip of upholstery fabric, attached to the outer long edge of the generally horizontal ledge of the stationary part and to the side wall of the reclining part remote the upright wall upwardly spaced from the elongate base, so as to cover the gap defined between the generally horizontal ledge and the side wall of the reclining part remote the upright wall of the stationary part in the reclined position of the reclining part and, ideally, to conceal the opening in the side wall in the upright position of the reclining part.

Preferably, the flexible strip is straight when the reclining part is upright. Ideally, the flexible strip flexes and/or folds to compensate for the reduced distance between the ledge and the region on the side wall where the flexible strip is attached when the reclining part is in the reclined position.

Preferably, in a fully reclined position, the upwardly facing side wall of the reclining part is substantially coplanar with an upper surface of the stationary part connecting the upright walls defining the L-shaped recesses.

The reclining mechanism of the present invention can be used with one or more reclining parts of an item of furniture. For example, it can be used in a sofa, a sofa-bed, a couch or an armchair for providing the reclining function to one or both armrests thereof. Furthermore, a reclining mechanism of the present invention can provide the reclining function to a backrest of an item of furniture.

DETAILED DESCRIPTION OF PREFERRED EMBODIMENTS

The invention will now be described with reference to the accompanying drawings, which show by way of example only, embodiments of a reclining mechanism in accordance with the invention.

Figure 7:
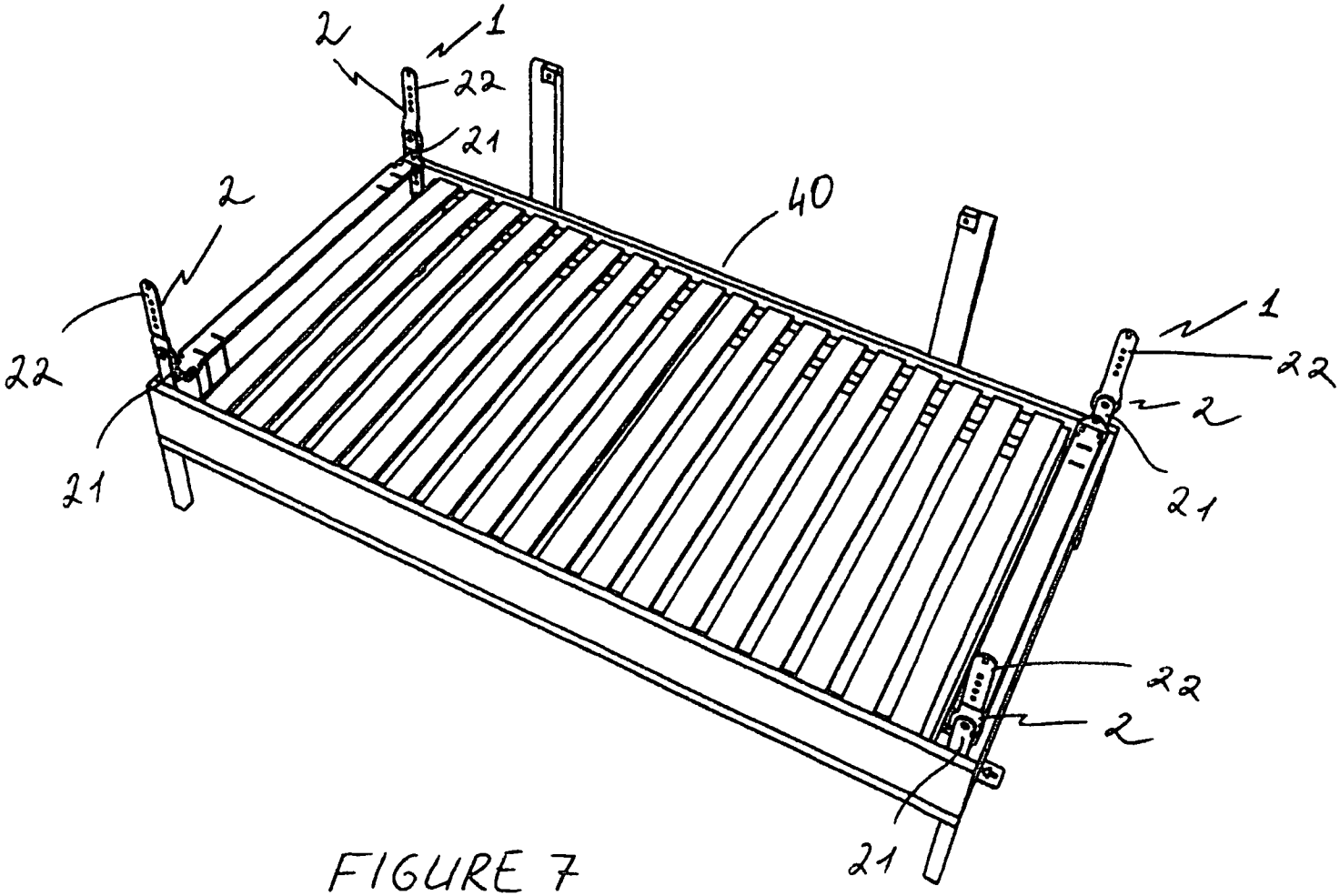
FIG. 7 is a perspective view of a partially assembled a sofa equipped with a pair of reclining mechanisms of the invention.
Figure 11:
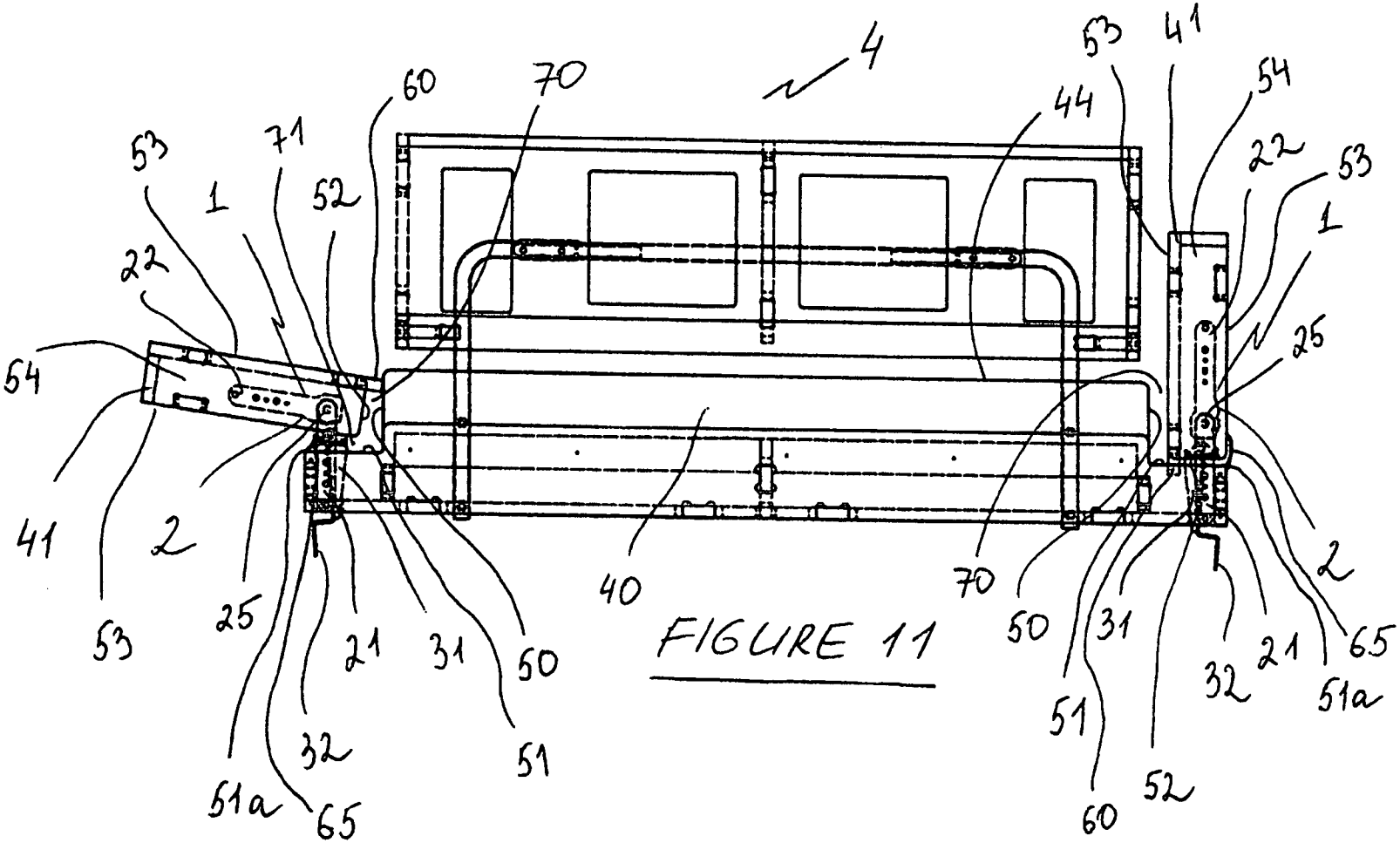
Figure 12:
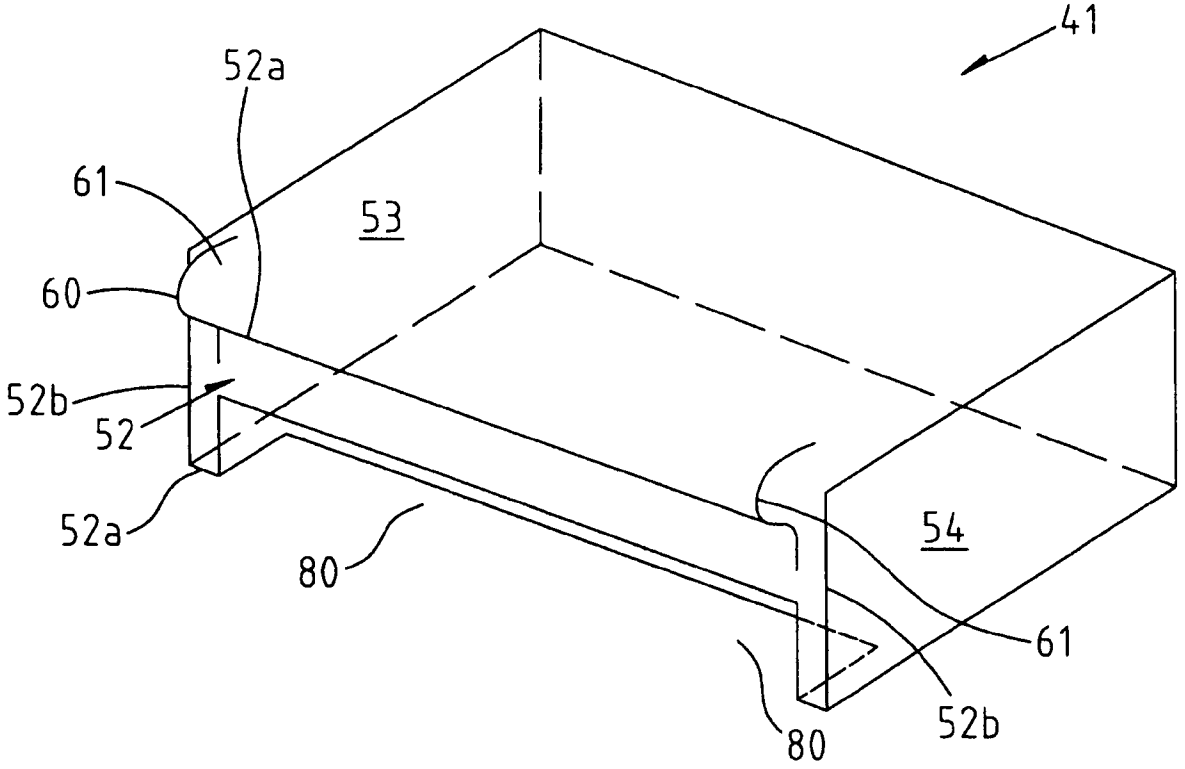
Figure 13:
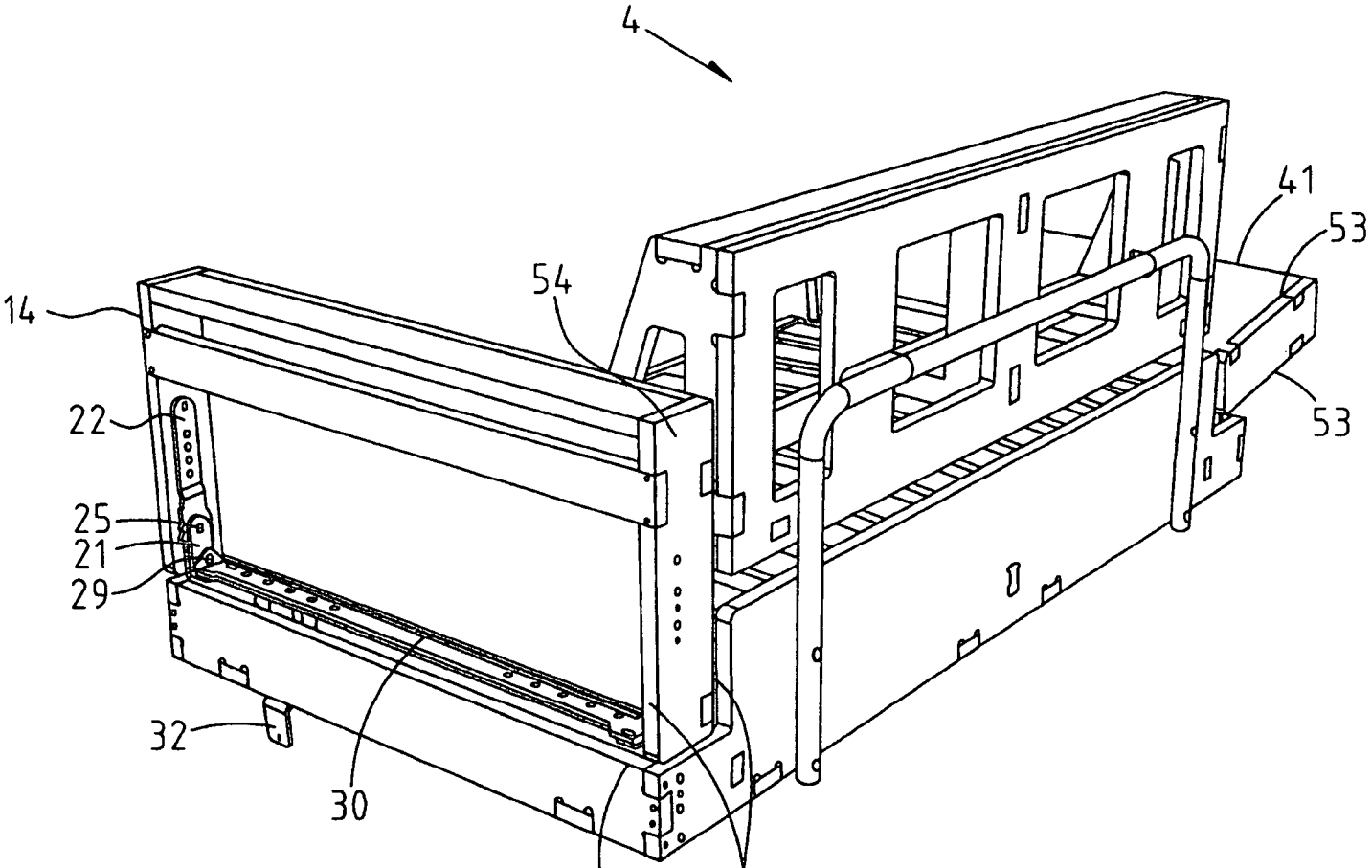

FIGS. 8, 9 and 10 respectively are a plan, end and front views of the sofa of FIG. 7;

FIG. 11 is a front elevation of a fully assembled sofa without upholstery equipped with a pair of reclining mechanisms according to the invention;

FIG. 12 is a perspective view of an upholstered armrest of the sofa of FIG. 11;

FIG. 13 is a rear perspective view of the sofa of FIG. 11; and

Figure 14:
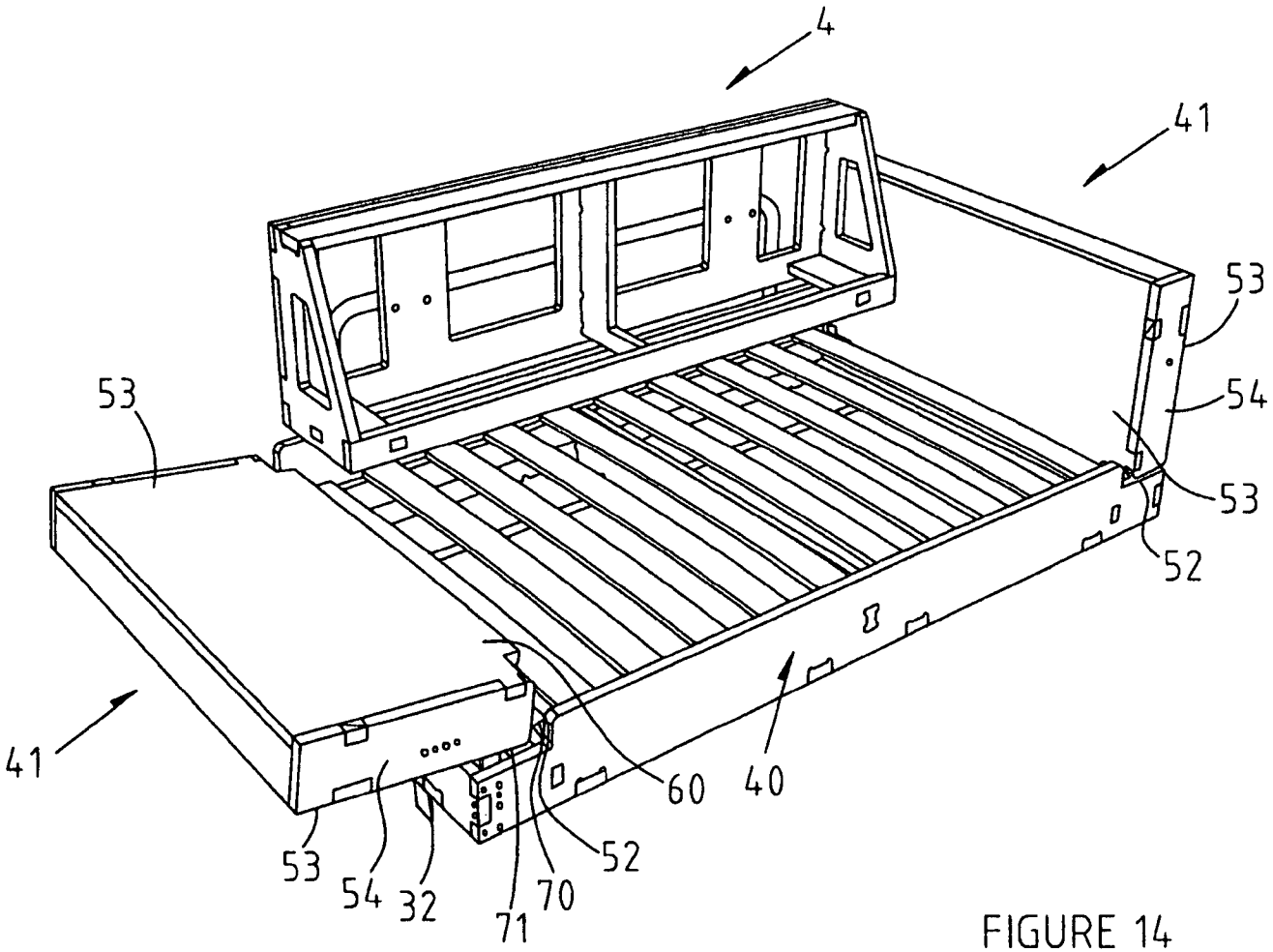

FIG. 14 is a front perspective view of the sofa of FIG. 11.

Referring initially to FIGS. 1 to 4, the reclining mechanism of the invention is indicated generally by reference numeral 1. The reclining mechanism 1 of the preset invention will be described in conjunction with a sofa. It will be however appreciated that such a use of the reclining mechanism of the present invention is disclosed for the purpose of illustration. The reclining mechanism of the present invention can be equally well utilized in conjunction with other types of furniture, in particular, but not limited thereto, sitting furniture, such as sofa-beds, armchairs, couches or the like, or indeed with any item of furniture which has a stationary part and a reclining part movable between upright and reclined positions.

The reclining mechanism 1 comprises pair of linkage units 2. Each linkage unit 2 comprises a first arm 21 adapted to be secured to a stationary seat 40 of a sofa 4 (FIGS. 7 to 11) and a second arm 22 adapted to be secured to a reclining armrest 41 of the sofa 4 for moving the armrest 41 between upright and reclined positions. The first and the second arms 21, 22 are connected to each other at their first ends 23, 24, respectively, to pivot with respect to each other about a first pivot axis 25. The linkage units 2 are spaced apart from each other so that their first pivot axes 25 are collinear.

Figure 4:
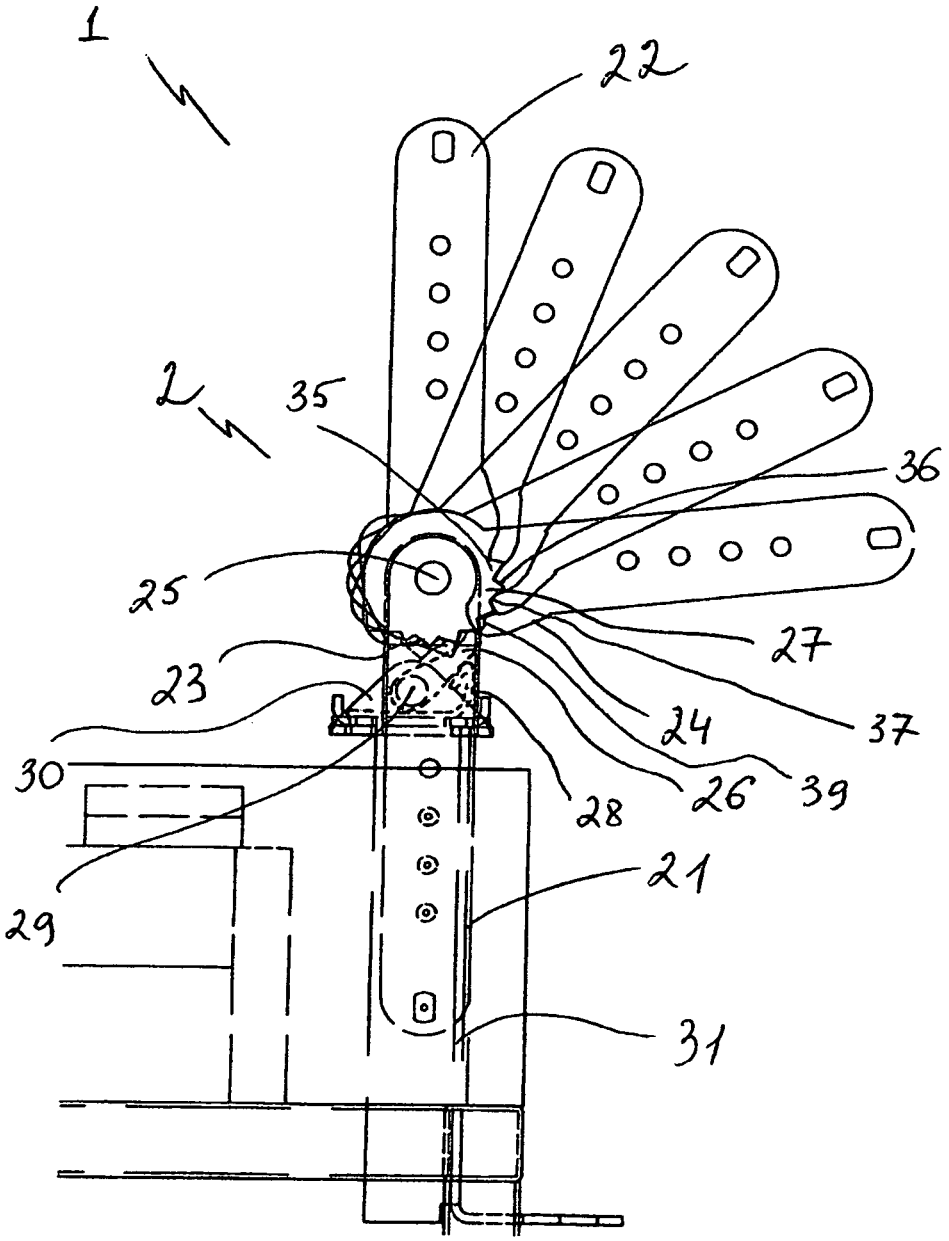
FIG. 4 is an end elevation of the reclining mechanism of FIG. 1 showing transitional positions of the reclining mechanism between the upright and the reclined modes.

Referring particularly to FIG. 4, a ratchet arrangement is provided between the first and the second arms 21, 22 adjacent the first pivot axis 25. The ratchet arrangement comprises a first engaging member in the form of pawl 26 rotatably mounted on the first arm 21. The pawl 26 is releasably engaged with a second engaging member in the form of a gear 27 provided at the first end 24 of the second arm 22. A biasing means in the form of a leaf spring 28 is secured to the first arm 21 at one end of the spring 28 and is slidably engaged with the pawl 26 at the other end of the spring 28. The spring 28 biases the pawl 26 into engagement with the gear 27.

Figure 1:
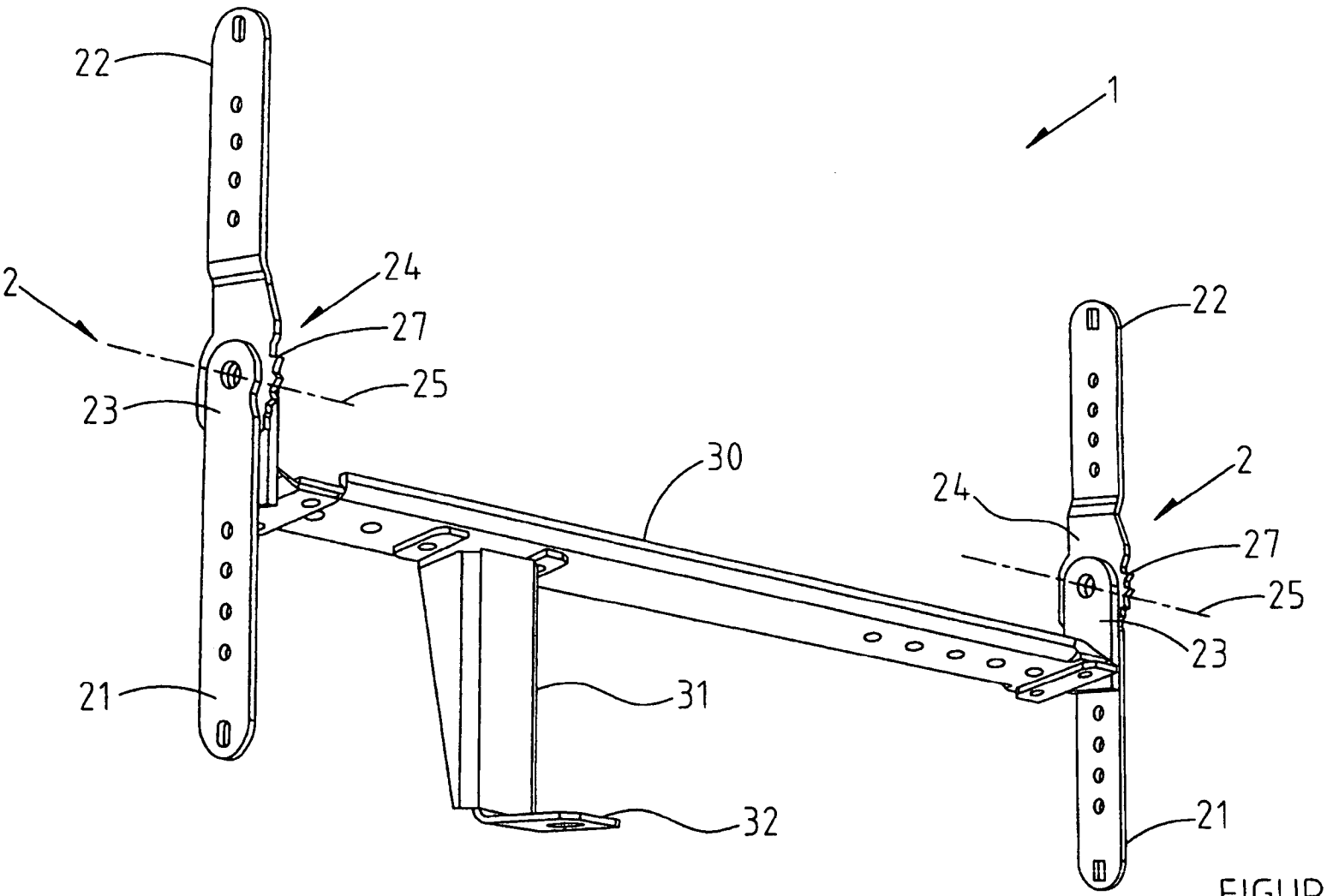
FIG. 1 is a perspective view of a reclining mechanism in accordance with the invention.
Figure 3:
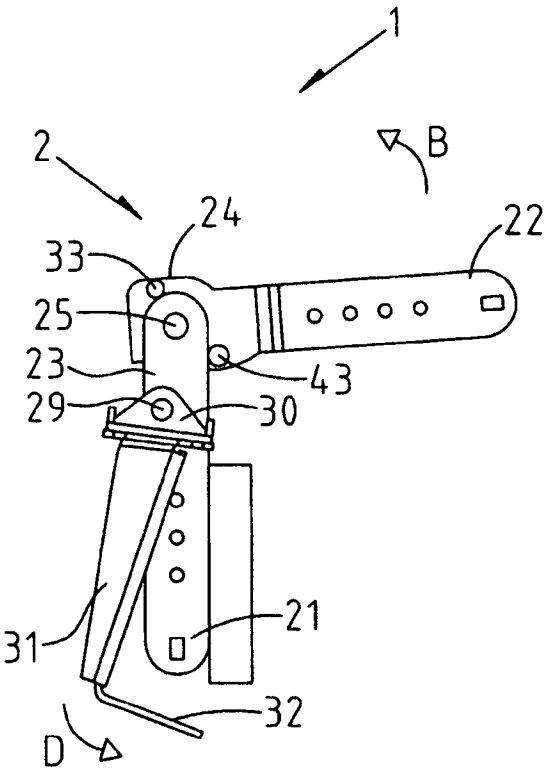
FIG. 3 is an end elevation of the reclining mechanism of FIG. 1 in a reclined mode.

As best shown in FIG. 1, the linkage units 2 are connected by a pivot bar 30 pivotable about a second pivot axis 29 substantially parallel the first pivot axes 25. The pivot bar 30 is connected at its ends to the pawls 26 so that the pivot bar 30 and the pawls 26 are pivotable together about the second pivot axis 29. A lever 31 extends radially from the pivot bar 30 for pivoting the pivot bar 30. The lever 31 is actuatable by applying to it an external force tangentially to the second pivot axis 29. Also, the lever 31 comprises a free end provided with a pedal 32 for actuating the lever 31 by foot or hand.

Referring again to FIG. 4, the gear 27 comprises asymmetrical teeth 35. Each tooth 35 has first and second slopes 36, 37 respectively.

In a first mode of operation of the reclining mechanism 1, the pawl 26 of each linkage unit 2 is biased into an engagement with the teeth 35 of the gear 27 by the spring 28. When the second arm 22 is rotated from the reclined to the upright position (indicated by arrow B in FIG. 3), the first slope 36 of a tooth 35 slides up and over the pawl 26 at the same time overcoming the bias force of the spring 28 and pushing the pawl 26 out of a valley 39 between a pair of adjacent teeth 35. Once the tip of the tooth 35 has passed the pawl 26 the spring 28 pushes the pawl 26 so that it snaps into the valley 29 between the next pair of adjacent teeth 35. When an attempt is made to rotate the second arm 22 from the upright to the reclined position (indicated by arrow A in FIG. 2) the second slope 37 of a tooth 35 catches against the pawl 26 and locks therewith thereby preventing any further rotation in this direction. Thus, in the first mode of operation (i.e. when the pawl 26 is engaged with the gear 27, the second arm 22 is prevented from rotation from an upright to a reclined position while remaining rotatable from a reclined position to an upright position.

Each linkage unit 2 includes a first stop member 33 provided on the second arm 22 (FIGS. 2 and 3) for preventing further rotation of the second arm 22 once it has moved from the reclined into the upright position in which the first stop member 33 encounters the first arm 21. Thus, in the first mode of operation, once the second arm 22 has reached the upright position, it is prevented from rotation in both directions, i.e. the second arm 22 remains in a fixed upright position with respect to the first arm 21.

In a second mode of operation (FIGS. 3 and 6), the lever 31 is actuated by pushing the pedal 32, whereby the pivot bar 30 is pivoted about the second pivot axis 29, whereby the pawls 26 are rotated away from the respective gears 27 overcoming the bias force of the spring 28; and whereby the pawls 26 become disengaged from the teeth 35 of the gears 27 so that the second arm 22 is free to rotate about the first pivot axis 25 between upright and reclined positions.

Each linkage unit 2 includes a second stop member 43 provided on the second arm 22 for preventing further rotation of the second arm 22 once the second arm 22 has rotated from the upright to the reclined position in which the second stop member 43 encounters the first arm 21. Thus, in the second mode of operation (i.e. when the pawls 26 are disengaged from the gears 27), once the second arm 22 has reached the reclined position, it is prevented from further rotation by the second stop member 43, but can be rotated freely back towards the upright position. As is apparent from FIG. 3, in the reclined position, the first and the second arms 21, 22 are positioned at a substantially right angle with respect to one another and, in use, the first arm 21 remains substantially upright and the second arm 22 is substantially horizontal.

Although not shown in the drawings, the centre of gravity of the second arm 22 in a linkage 2 unit is preferably located so that once the linkage units 2 are brought into in the second mode of operation (i.e. the pawls 26 disengage from the gears 27) and the second arms 22 are free to rotate, the second arms 2 rotate under the influence of gravity from the upright position into the reclined position.

Due to such an arrangement of the reclining mechanism 1, by a single actuation of the lever 31, the second arms 22 of the linkage units 2 are brought into the second mode of operation so that the second arms 22 are free to rotate relative to the respective first arms 21 and, accordingly, so that the armrest 41 can be readily reclined or raised.

Figure 2:
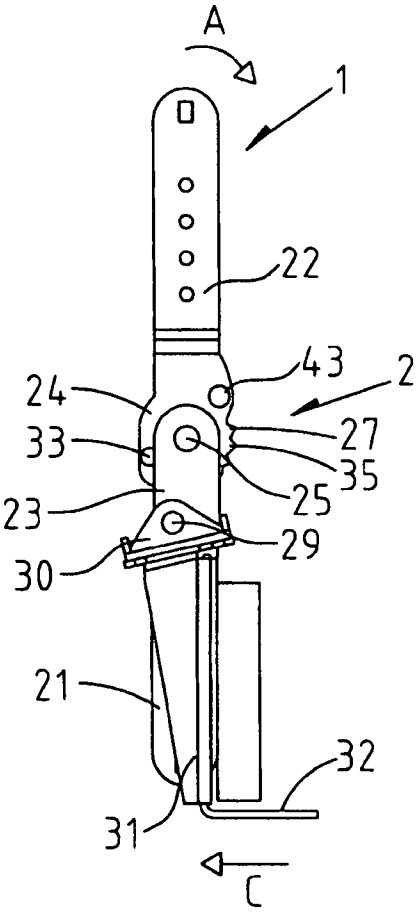
FIG. 2 is an end elevation of the reclining mechanism of FIG. 1 in an upright mode.

In the first mode of operation of the reclining mechanism, the lever 31 remains in a rest position whereas in the second mode of operation, the lever 31 is actuated and moved from the rest position to a biased position upon application of the external force to the pedal 32 (as indicated by arrow C in FIG. 2). Once the external actuating force acting on lever 31 the has been removed, the spring 28 returns into its initial position thereby moving the pawl 26 back into the engagement with the gear 27, thereby pivoting the pivot bar 30 about the second pivot axis 25 in the reverse direction (indicated by arrow D in FIG. 3), thereby bringing the lever 31 back into the rest position and bringing the reclining mechanism 1 into the first mode of operation. Accordingly, once the second arm 22 has moved into the reclined position, and the pawls 26 have engaged the gears 27, the second arm is prevented from further rotation by the ratchet arrangement; but can be raised to the upright position without using the lever 31. The teeth 37 of the gears 27 provide a series of discrete positions (FIG. 4) for the second arm 22 as it rotates from the reclined to the upright position, so that the user can adjust the angle of inclination of the armrest or backrest in use.

As shown in FIGS. 7 to 14, in use, the first arm 21 is fixed to the seat 40 of the sofa 4, whereas the second arm 22 is fixed to an armrest 41 (FIG. 11). The linkage units 2 are spaced along adjoining sides of the armrest 41 and the seat 40.

The reclining mechanism 1 is built into the sofa 4, so that the lever 31 extends downwardly from the pivot bar 30 inside the seat 40 and remains concealed within the seat 40 together with the pivot bar 30, whereas the pedal 32 projects laterally from underneath the seat 40, so that it can be accessed by a user and actuated e.g. by foot or hand.

Figure 6:
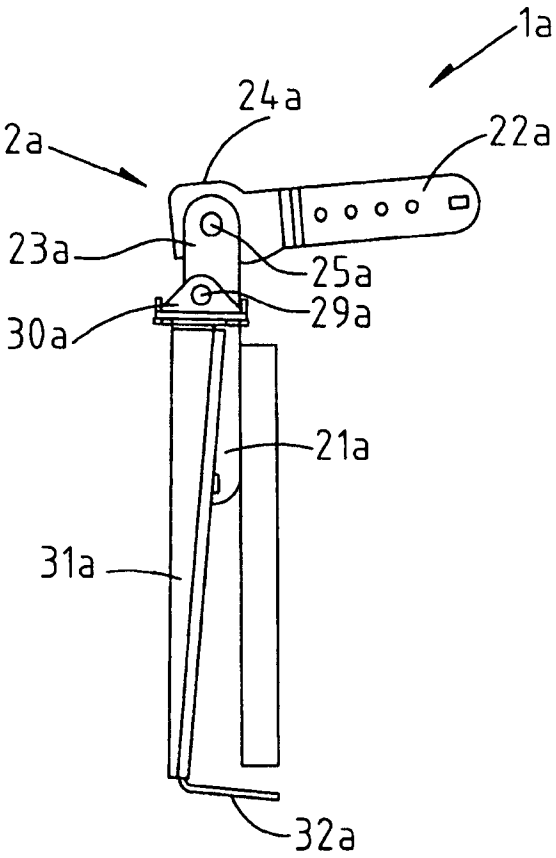
FIGS. 5 and 6 are end elevations of a variation of a reclining mechanism of FIG. 1 in an upright mode and a reclined mode, respectively.
Figure 5:
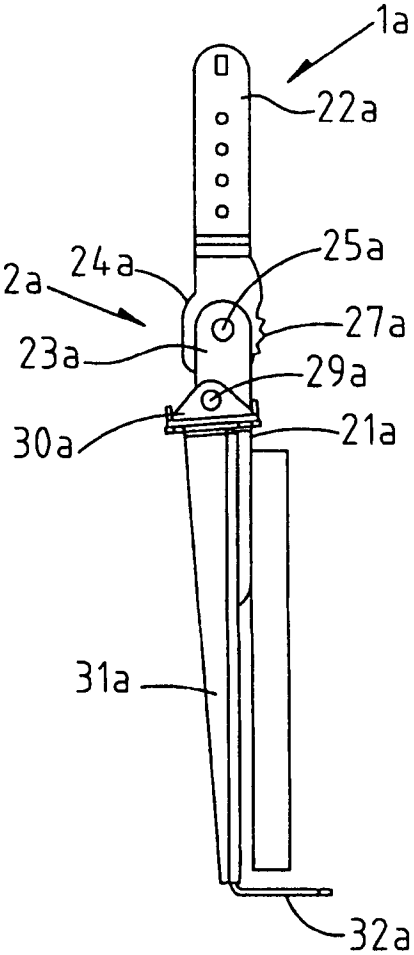

FIGS. 5 and 6 illustrate a preferred configuration of the reclining mechanism of the invention which is indicated generally by reference numeral 1*a*. The remaining components of the reclining mechanism 1*a* have been indicated by the same reference numerals as the reclining mechanism 1 with the addition of a letter "a" to each such reference numeral. In this variation, the pedal 32*a* sufficiently projects laterally outwardly from underneath the seat in the rest position of the lever 31*a*. In the biased position of the lever 31*a*, the pedal 32*a* is pushed inwardly with respect to the exterior of the seat whereby the lever 31*a* is tilted inwardly through a pre-determined angle. The spring of the ratchet arrangement is configured in such a manner and the length of the lever 31*a* and the pre-determined tilt angle are selected such that in the biased position of the lever 31*a* the pedal 32*a* remains partially projecting from underneath the seat, so that the user does not need to reach underneath the seat order to actuate the lever 31*a* fully.

Referring to FIGS. 11 to 14, the seat 40 part comprises a generally L-shaped in cross section recess defined by an upright wall 50 and a generally horizontal ledge 51 of the seat 40 for receiving a generally U-shaped in cross-section armrest 41 comprising an elongate base 52 comprising a pair of long edges 52*a* and an pair of short edges 52*b* and a pair opposing side walls 53 upstanding from the long edges 52*a* of the base 52 and a pair of opposing end walls 54 upstanding from the short edges 52*b* of the base.

As shown on the right hand side of FIG. 11, in an upright position of the armrest 41, the elongate base 52 extends substantially parallel the ledge 51 of the seat 40, whilst the side walls 53 extend substantially vertically, substantially parallel the upright wall 50 of the seat 40.

Conversely, as shown on the left hand side of FIG. 11, in a reclined position of the armrest 41, the elongate base 52 extends substantially parallel the upright wall 50, whilst the side walls 53 extend substantially parallel the ledge 51 of the seat 40.

The first pivot axis 25 of the reclining mechanism 1 is substantially parallel the ledge 51 and the upright wall 50 of the seat 40. Furthermore, the first pivot axis 25 is spaced inwardly with respect to the exterior of the armrest 41 from the elongate base 52 and from the side walls 53. In the upright position, one of the side walls 53 of the armrest abuts the upright wall of the seat 40. Advantageously, the elongate base 52 of the armrest 41 is sufficiently spaced upwardly from the ledge 51 to provide clearance for the rotary movement of the armrest 41 about the first pivot axis 25 between the upright and the reclined positions. In particular, due to this arrangement, a portion of the elongate base 52 most remote from the first pivot axis 25 in the direction away from the upright wall 50 slides against the ledge 51 during the movement of the armrest 41 between the reclined and the raised positions.

Still referring to FIGS. 11 to 14, the armrest 41 comprises a first elongate shield member 60 extending along a long edge 52*a* of the elongate base 52 of the armrest 41 adjacent the upright wall 50 of the seat 40 and projecting proud from the elongate base 52, so that in the reclined position of the armrest 41 the first shield member 60 covers a gap 70 defined between the upright wall 50 of the seat 40 and the elongate base 52, whereas in the upright position of the armrest 41, the first shield member 60 is concealed within the seat 40. The elongate base 52 of the armrest 41 is upwardly spaced from the ledge 51 and the first pivot axis 25 is inwardly spaced from the elongate base 52 and laterally away from the upright wall 50 of the seat 40. A recess is provided in the upright wall 50 for accommodating the elongate shield member 60 during the rotary movement of the armrest 41 about the first pivot axis 25 between the upright and the reclined positions. Although not shown in the drawings, the recess is covered with upholstery fabric which sags under the pressure of the shield member 60 during the rotary movement of the armrest 41 about the first pivot axis 25 between the upright and the reclined positions thereby allowing the shield member 60 to enter the recess and to pivot with respect to the seat 40.

As shown in FIG. 12, ends 61 of the elongate first shield member 60 are located spaced from the corresponding short sides 52*b* of the elongate base 52 and, accordingly, the recess in the upright wall 50 of the seat 40 is confined within the boundaries of the upright wall 50, i.e. it is shorter than the width of the upright wall 50, so that the recess is not visible during the use of the sofa 4.

As shown in FIG. 12, slots 80 are formed in the elongate base 52 of the armrest 41 and in the side wall 53 thereof remote the upright wall 50 of the seat 40 for bypassing portions of the first arms 21 of the linkage units 2 which remain stationary during the rotation of the second arms 22 with respect to the first arms 21.

As shown in FIG. 13, a hollow area is defined inside the armrest 41 for accommodating parts of the reclining mechanism 1. Also, as shown in FIG. 12, a portion of the elongate base 52 of the armrest 41 and a portion of the side wall 53 thereof remote the upright wall 50 of the seat 40 are removed thereby providing openings 80 to enable the armrest 41 to move with respect to the first arms 21 of the linkage units 2 which remain stationary during the rotation of the armrest 41. As shown in FIG. 13, the pivot bar 30 and portions of the first arms 21 containing the first ends 23 are accommodated within the hollow area of the armrest 41.

As shown in FIG. 11, a second elongate shield member 65 extends along an outer long edge 51*a* of the generally horizontal ledge 51 of the seat 40 and projects upwardly therefrom such that in the reclined position of the armrest 41, the second shield member 65 covers a gap 71 defined between the generally horizontal ledge 51 and the side wall 53 of the armrest 41 remote the upright wall of the seat 40. The shield member 65 is provided in the form of a strip of upholstery fabric attached to the outer long edge 51*a* of the ledge 51 and to the side wall 53 of the armrest 41 remote the upright wall 50 upwardly spaced from the elongate base 52 so as to cover the gap 71 in the reclined position of the armrest 41 and to conceal the opening 80 in the side wall 53 in the upright position of the armrest 41. As shown on the right hand side of FIG. 11, the shield member 65 is substantially straight when the armrest 41 is upright. As shown on the left hand side of FIG. 11, the shield member 65 flexes and/or folds to compensate for the reduced distance between the ledge 51 and the region on the side wall 53 to which the shield member 65 is attached when the armrest 41 is in the reclined position.

As shown in FIG. 11, in a fully reclined position, the upwardly facing side wall 53 of the armrest 41 is substantially coplanar with an upper surface 44 of the seat 40 connecting the upright walls 50 defining the L-shaped recesses.

The present invention provides a reclining mechanism which is relatively simple in construction, easy to manufacture and convenient in use.

It will be appreciated that the present invention is not limited to the specific details herein described which are given by way of example only, and that various alternations and modifications may be made without departing from the scope of the invention as defined in the appended claims.

The invention claimed is:

1. A reclining mechanism for an item of furniture, the reclining mechanism comprising:

a pair of linkage units, each linkage unit comprising a first arm adapted to be secured to a stationary part of an item of furniture and a second arm adapted to be secured to a reclining part of the item of furniture for moving the reclining part between upright and reclined positions;

wherein the first and the second arms are connected to each other at their first ends to pivot with respect to each other about a first pivot axis; the linkage units being spaced apart from each other so that their first pivot axes are collinear;

wherein a spring biased ratchet arrangement is provided between the first and the second arms adjacent the first pivot axis;

wherein the linkage units are connected by a pivot bar pivotable about a second pivot axis substantially parallel to the first pivot axes; wherein the pivot bar is connected at its ends to the ratchet arrangement of each linkage unit; and wherein the pivot bar is pivotable about the second pivot axis by a lever, the pivot bar being operable to disengage the ratchet arrangement;

wherein in a first mode of operation of the reclining mechanism, the ratchet arrangement is bias loaded and is engaged with the first and the second arms of the linkage unit so that the second arm is prevented from rotation about the first pivot axis in a first direction from an upright to a reclined position while remaining rotatable in a second opposite direction from a reclined position to an upright position; and wherein in a second mode of operation the lever is actuated, whereby the pivot bar is pivoted about the second pivot axis thereby releasing the ratchet arrangement from the bias load thereby releasing the second arm so that the second arm is free to rotate about the first pivot axis between upright and reclined positions.

2. A reclining mechanism as claimed in claim 1, wherein in use the first arm is fixed to a stationary portion of an item of furniture, whereas the second arm is fixed to a reclining portion of the item of furniture.

3. A reclining mechanism as claimed in claim 1, wherein each linkage unit includes a first stop member arranged to prevent further rotation of the second arm in the second direction once it has moved from the reclined into the upright position, so that in the first mode of operation, once the second arm has reached the upright position, it is prevented from rotation in both the first and the second directions, whereby the second arm assumes a fixed upright position with respect to the first arm.

4. A reclining mechanism as claimed in claim 1, wherein each linkage unit includes a second stop member arranged to prevent rotation of the second arm in the first direction once the second arm has rotated from the upright to the reclined position, so that in the second mode of operation, once the second arm has reached the reclined position, it is prevented from further rotation in the first direction by the second stop member, but can be rotated freely in the second direction towards the upright position.

5. A reclining mechanism as claimed in claim 1, wherein in the reclined position the first and the second arms are positioned at a substantially right angle with respect to one another and, in use, the first arm is substantially upright and the second arm is substantially horizontal.

6. A reclining mechanism as claimed in claim 1, wherein the ratchet arrangement comprises a first engaging member movably mounted on the first arm, the first engaging member being releasably engaged with a second engaging member provided at the second arm; and the bias load is provided by a biasing means biasing the first engaging member into the engagement with the second engaging member.

7. A reclining mechanism as claimed in claim 6, wherein the pivot bar is connected at its ends to the first engaging members.

8. A reclining mechanism as claimed in claim 6, wherein in a first mode of operation of the reclining mechanism, the first engaging member is biased into an engagement with the second engaging member by the biasing means so that the second arm is prevented from rotation about the first pivot axis in a first direction from an upright to a reclined position whilst remaining rotatable in a second opposite direction from a reclined position to an upright position; and wherein in a second mode of operation the lever is actuated, whereby the pivot bar is pivoted about the second pivot axis, whereby the first engaging members are moved away from the respective second engaging members overcoming the bias force of the biasing means; and whereby the first engaging members become disengaged from the second engaging member so that the second arm is free to rotate about the first pivot axis between upright and reclined positions.

9. A reclining mechanism as claimed in claim 1, wherein the lever is actuatable via an application of an external force thereto.

10. A reclining mechanism as claimed in claim 1, wherein the lever extends radially from the pivot bar, wherein the lever is actuatable via an application of an external force thereto; and wherein the external force is preferably tangential to the second pivot axis.

11. A reclining mechanism as claimed in claim 8, wherein once the external actuating force acting on the lever has been removed, the biasing means returns into its initial position thereby moving the first engaging members back into the engagement with their respective second engaging members, thereby pivoting the pivot bar about the second pivot axis in the reverse direction, thereby bringing the lever back into the rest position and bringing the reclining mechanism into the first mode of operation, whereby once the second arm has moved into the reclined position, it is prevented from further rotation in the first direction by the ratchet arrangement, but remains rotatable to the upright position without using the lever.

12. A reclining mechanism as claimed in claim 10, wherein the ratchet arrangement is adapted to provide a series of discrete positions for the second arm as it rotates in the second direction in the first mode of operation of the reclining mechanism.

13. A reclining mechanism as claimed in claim 6, wherein the first engaging member is pivotally mounted on the first arm to pivot about the second pivot axis together with the pivot bar.

14. A reclining mechanism as claimed in claim 6, wherein the first engaging member comprises a pawl and the second engaging member comprises a gear.

15. A reclining mechanism as claimed in claim 14, wherein the gear preferably comprises asymmetrical teeth, wherein each tooth has first and second slopes configured so that when the second arm is rotated in the second direction from the reclined to the upright position in the first mode of operation of the reclining mechanism, the first slope of a tooth slides up and over the pawl at the same time overcoming the bias force of the biasing means and pushing the pawl out of a valley between a pair of adjacent teeth; wherein once a tip of the tooth has passed over the pawl, the bias means pushes the pawl into the valley between the next pair of adjacent teeth; wherein when an attempt is made to rotate the second arm in the first direction from the upright to the reclined position in the first mode of operation of the reclining mechanism, the second slope of a tooth catches against the pawl and locks therewith thereby preventing any further rotation in the first direction.

16. A reclining mechanism as claimed in claim 6, wherein the biasing means comprises a biasing member mounted between the first arm and the first engaging member.

17. A reclining mechanism as claimed in claim 6, wherein the biasing member is provided in the form of a spring, preferably a leaf spring.

18. A reclining mechanism as claimed in claim 17, wherein the leaf spring is secured to the first arm at one end and is slidably engaged with the first engaging member at the other end.

19. A reclining mechanism as claimed in claim 1, wherein the centre of gravity of the second arm in the linkage unit is located so that in use once the linkage units are brought into in the second mode of operation in which the second arms are free to rotate, the second arms rotate under the influence of gravity from the upright position into the reclined position.

20. A reclining mechanism as claimed in claim 1, wherein in the first mode of operation of the reclining mechanism, the lever remains in a rest position whereas in the second mode of operation, the lever is actuated and moved from the rest position to a biased position upon application of the external force.

21. An item of furniture comprising a reclining mechanism as claimed in claim 1, wherein the reclining mechanism is built into an item of furniture so that the first arms are secured within a stationary part of the item of furniture and the second arms are secured within a reclining part of the item of furniture, whereas the linkage units are spaced along adjoining sides of the stationary part and the reclining part.

22. An item of furniture comprising a reclining mechanism as claimed in claim 21, wherein the lever comprises a free end provided with a pedal; wherein the reclining mechanism is built into an item of furniture so that the lever extends downwardly from the pivot bar inside the stationary part and remains concealed within the stationary part together with the pivot bar, whereas the pedal sufficiently projects laterally from underneath the stationary part in the rest position of the lever, so that it can be accessed by a user and actuated; wherein in the biased position of the lever, the pedal is pushed inwardly with respect to the exterior of the stationary part, whereby the lever is tilted inwardly through a pre-determined angle.

23. An item of furniture as claimed in claim 22, wherein the biasing means of the ratchet arrangement is configured in such a manner and the length of the lever and the pre-determined angle are selected such that in the second position the pedal is at least partially concealed underneath the stationary part.

24. An item of furniture as claimed in claim 23, wherein in the second position, the pedal partially projects from underneath the stationary part, so that the user does not need to reach underneath the stationary part in order to actuate the lever.

25. An item of furniture as claimed in claim 21, wherein the stationary part comprises a generally L-shaped in cross section recess defined by an upright wall and a generally horizontal ledge of the stationary part for receiving a generally U-shaped in cross-section reclining part comprising an elongate base comprising a pair of long edges and an pair of short edges and a pair opposing side walls upstanding from the long edges of the base and a pair of opposing end walls upstanding from the short edges of the base.

26. An item of furniture as claimed in claim 25, wherein in an upright position of the reclining part, the elongate base extends substantially parallel the ledge of the stationary part, whereas the side walls extend substantially vertically, substantially parallel the upright wall of the stationary part.

27. An item of furniture as claimed in claim 25, wherein in a reclined position of the reclining part, the elongate base extends substantially parallel the upright wall, whilst the side walls extend substantially parallel the ledge of the stationary part.

28. An item of furniture as claimed in claim 25, wherein the first pivot axis is substantially parallel the ledge and the upright wall of the stationary part; wherein the first pivot axis is spaced inwardly with respect to the exterior of the reclining part from the elongate base and from the side walls; wherein in the upright position, one of the side walls of the reclining part abuts the upright wall of the stationary part; and wherein the elongate base of the reclining part is sufficiently upwardly spaced from the ledge to provide clearance for the rotary movement of the reclining part about the first pivot axis between the upright and the reclined positions.

29. An item of furniture as claimed in claim 28, wherein the elongate base of the reclining part is upwardly spaced from the ledge and the first pivot axis is inwardly spaced from the elongate base of the reclining part and from a side wall of the reclining part remote the upright wall of the stationary part so that a portion of the elongate base most remote from the first pivot axis slides against a portion of the ledge during the movement of the reclining part between the reclined and the raised positions.

30. An item of furniture as claimed in claim 29, wherein the reclining part comprises a first elongate shield member extending along a long edge of the elongate base of the reclining part adjacent the upright wall of the stationary part and projecting proud from the elongate base, so that in the reclined position of the reclining part the first shield member covers a gap defined between the upright wall of the stationary part and the elongate base, whereas in the upright position of the reclining part the first shield member is concealed within the interior of the stationary part.

31. An item of furniture as claimed in claim 30, wherein the elongate base of the reclining part is upwardly spaced from the ledge and the first pivot axis is inwardly spaced from the elongate base of the reclining part and laterally outwardly with respect to the exterior of the stationary part from the upright wall of the stationary part and a recess is provided in the upright wall for accommodating the elongate shield member during the rotary movement of the reclining part about the first pivot axis between the upright and the reclined positions.

32. An item of furniture as claimed in claim 31, wherein the recess is covered by a flexible cover, ideally made from upholstery fabric which sags under the pressure of the shield member during the rotary movement of the reclining part about the first pivot axis between the upright and the reclined positions thereby allowing the shield member to enter the recess.

33. An item of furniture as claimed in claim 32, wherein ends of the elongate first shield member are located spaced from the corresponding short sides of the elongate base and, accordingly, the elongate shield member is shorter than the width of the upright wall so that it is received in the recess in the upright wall of the stationary part within the boundaries of the upright wall.

34. An item of furniture as claimed in any one of claims 25 to 33, wherein a hollow area is defined inside the reclining part at least adjacent the elongate base for accommodating parts of the reclining mechanism.

35. An item of furniture as claimed in claim 34, wherein a portion of the elongate base of the reclining part and a portion of the side wall thereof remote the upright wall of the stationary part are removed thereby providing openings to enable the reclining part to move with respect to the first arms of the linkage units which remain stationary during the rotation of the second arms without interfering with the first arms.

36. An item of furniture as claimed in claim 35, wherein the pivot bar and a portion of the first arm containing the first end of the first arm are disposed within the hollow area of the reclining part.

37. An item of furniture as claimed in claim 25, wherein a second elongate shield member extends along an outer long edge of the generally horizontal ledge of the stationary part and projects upwardly therefrom such that in the reclined position of the reclining part, the second shield member covers a gap defined between the generally horizontal ledge and the side wall of the reclining part remote the upright wall of the stationary part.

38. An item of furniture as claimed in claim 37, wherein the shield member is provided in the form of a flexible strip attached to the outer long edge of the generally horizontal ledge of the stationary part and to the side wall of the reclining part remote the upright wall upwardly spaced from the elongate base, so as to cover the gap defined between the generally horizontal ledge and the side wall of the reclining part remote the upright wall of the stationary part in the reclined position of the reclining part.

* * * * *